US006508011B1

(12) United States Patent
Lee

(10) Patent No.: US 6,508,011 B1
(45) Date of Patent: Jan. 21, 2003

(54) BOLT HOLE MARKER

(76) Inventor: Jeffrey D. Lee, 2660 Bubbling Wells Rd., Riverside, CA (US) 92501

( * ) Notice: Subject to any disclaimer, the term of this patent is extended or adjusted under 35 U.S.C. 154(b) by 0 days.

(21) Appl. No.: 09/697,969

(22) Filed: Oct. 26, 2000

(51) Int. Cl.[7] ..... B25H 7/04

(52) U.S. Cl. ..... 33/666; 33/613; 33/669; 33/574

(58) Field of Search ..... 33/613, 645, 666, 33/518, 669, 677, 562, 574, 578

(56) References Cited

U.S. PATENT DOCUMENTS

| | | | | | |
|---|---|---|---|---|---|
| 3,406,460 | A | | 10/1968 | Colwell | |
| 4,363,173 | A | * | 12/1982 | Caldera | 33/666 |
| 4,520,571 | A | | 6/1985 | Harding | |
| 4,993,168 | A | | 2/1991 | Acuna | |
| 5,068,976 | A | | 12/1991 | Bell | |
| 5,129,154 | A | * | 7/1992 | Aydelott | 33/613 |
| 5,375,339 | A | | 12/1994 | Noel, Jr. | |
| D376,094 | S | | 12/1996 | Hubbard | |
| 5,937,613 | A | * | 8/1999 | Vess, Sr. | 33/613 |
| 6,055,736 | A | * | 5/2000 | Gaston | 33/613 |
| 6,077,000 | A | * | 6/2000 | Gibbons et al. | 33/613 |

* cited by examiner

*Primary Examiner*—Diego Gutierrez
*Assistant Examiner*—Madeline Gonzalez

(57) ABSTRACT

A bolt hole marker for marking the location where a hole needs to be drilled in a foundation. The bolt hole marker includes an elongate angled base member having a first elongate portion having a slot in an end thereof with the slot being adapted to receive an anchor bolt, and further having a second elongate portion also having a slot in an end thereof with that slot being adapted to receive an anchor bolt. The second elongate portion is angled at approximately 30 degrees from the first elongate portion. A first punch member for making indentations in a sill member is disposed through the first elongate portion and is positioned approximately 3¼ inches from the slot of the first elongate portion. A second punch member for making indentations in a sill member is disposed through the second elongate portion and is positioned approximately 3¼ inches from the slot of the second elongate portion.

1 Claim, 2 Drawing Sheets

BOLT HOLE MARKER

BACKGROUND OF THE INVENTION

1. Field of the Invention

The present invention relates to a marker for identifying the location of anchor bolts and more particularly pertains to a new bolt hole marker for marking the location where a hole needs to be drilled in a foundation.

2. Description of the Prior Art

The use of a marker for identifying the location of anchor bolts is known in the prior art. More specifically, a marker for identifying the location of anchor bolts heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,406,460; 5,375,339; 4,520,571; 5,068,976; 4,993,168; and U.S. Pat. No. Des. 376,094.

While these devices fulfill their respective, particular objectives and requirements, the aforementioned patents do not disclose a new anchor bolt locator. The inventive device includes an elongate angled base member having a first elongate portion having a slot in an end thereof with the slot being adapted to receive an anchor bolt, and further having a second elongate portion also having a slot in an end thereof with that slot being adapted to receive an anchor bolt. The second elongate portion is angled at approximately 30 degrees from the first elongate portion. A first punch member for making indentations in a sill member is disposed through the first elongate portion and is positioned approximately 3¼ inches from the slot of the first elongate portion. A second punch member for making indentations in a sill member is disposed through the second elongate portion and is positioned approximately 3¼ inches from the slot of the second elongate portion.

In these respects, the bolt hole marker according to the present invention substantially departs from the conventional concepts and designs of the prior art, and in so doing provides an apparatus primarily developed for the purpose of marking the location where a hole needs to be drilled in a foundation.

SUMMARY OF THE INVENTION

In view of the foregoing disadvantages inherent in the known types of a marker for identifying the location of anchor bolts now present in the prior art, the present invention provides a new bolt hole marker construction wherein the same can be utilized for marking the location where a hole needs to be drilled in a foundation.

The general purpose of the present invention, which will be described subsequently in greater detail, is to provide a new bolt hole marker apparatus and method which has many of the advantages of the marker for identifying the location of anchor bolts mentioned heretofore and many novel features that result in a new bolt hole marker which is not anticipated, rendered obvious, suggested, or even implied by any of the prior art a marker for identifying the location of anchor bolts, either alone or in any combination thereof.

To attain this, the present invention generally comprises an elongate angled base member having a first elongate portion having a slot in an end thereof with the slot being adapted to receive an anchor bolt, and further having a second elongate portion also having a slot in an end thereof with that slot being adapted to receive an anchor bolt. The second elongate portion is angled at approximately 30 degrees from the first elongate portion. A first punch member for making indentations in a sill member is disposed through the first elongate portion and is positioned approximately 3¼ inches from the slot of the first elongate portion. A second punch member for making indentations in a sill member is disposed through the second elongate portion and is positioned approximately 3¼ inches from the slot of the second elongate portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bolt hole marker apparatus and method which has many of the advantages of the marker for identifying the location of anchor bolts mentioned heretofore and many novel features that result in a new bolt hole marker which is not anticipated, rendered obvious, suggested, or even implied by any of the prior art a marker for identifying the location of anchor bolts, either alone or in any combination thereof.

It is another object of the present invention to provide a new bolt hole marker which may be easily and efficiently manufactured and marketed.

It is a further object of the present invention to provide a new bolt hole marker which is of a durable and reliable construction.

An even further object of the present invention is to provide a new bolt hole marker which is susceptible of a low cost of manufacture with regard to both materials and labor, and which accordingly is then susceptible of low prices of sale to the consuming public, thereby making such bolt hole marker economically available to the buying public.

Still yet another object of the present invention is to provide a new bolt hole marker which provides in the apparatuses and methods of the prior art some of the advantages thereof, while simultaneously overcoming some of the disadvantages normally associated therewith.

Still another object of the present invention is to provide a new bolt hole marker for marking the location where a hole needs to be drilled in a foundation.

Yet another object of the present invention is to provide a new bolt hole marker which includes an elongate angled base member having a first elongate portion having a slot in an end thereof with the slot being adapted to receive an anchor bolt, and further having a second elongate portion also having a slot in an end thereof with that slot being adapted to receive an anchor bolt. The second elongate portion is angled at approximately 30 degrees from the first elongate portion. A first punch member for making indentations in a sill member is disposed through the first elongate portion and is positioned approximately 3¼ inches from the slot of the first elongate portion. A second punch member for making indentations in a sill member is disposed through the second elongate portion and is positioned approximately 3¼ inches from the slot of the second elongate portion.

Still yet another object of the present invention is to provide a new bolt hole marker that is easier and more convenient to use than any of the prior art.

Even still another object of the present invention is to provide a new bolt hole marker that has two different sizes for marking holes in a foundation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
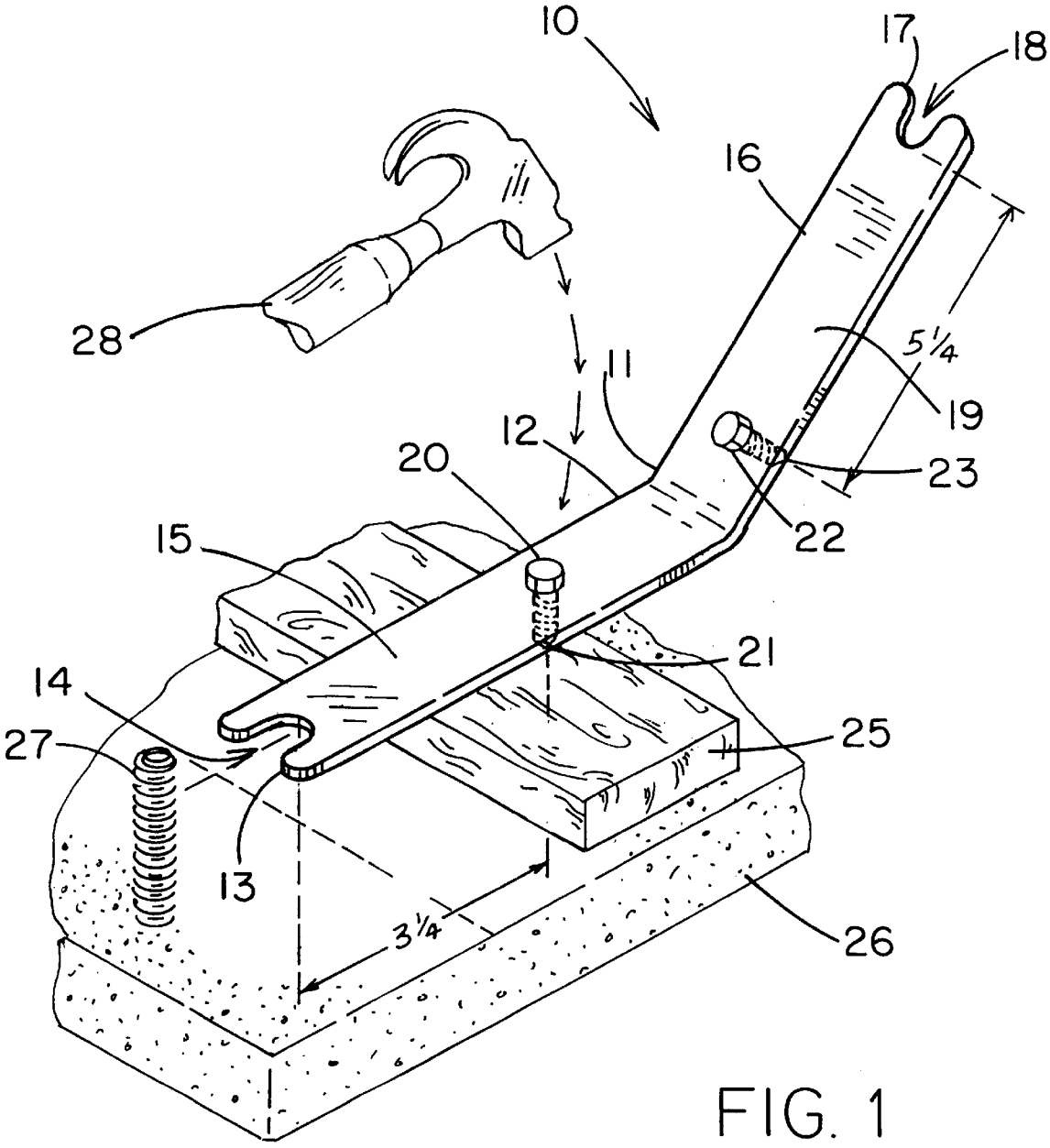
FIG. 1 is a perspective view of a new bolt hole marker according to the present invention in use.
Figure 2:
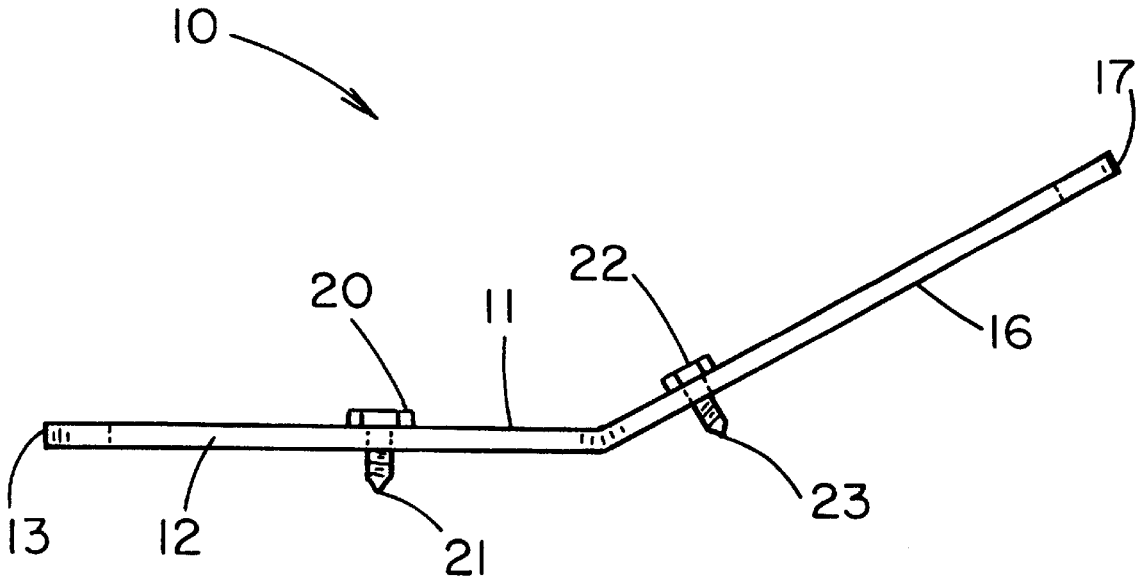
FIG. 2 is a side elevational view of the present invention.
Figure 3:
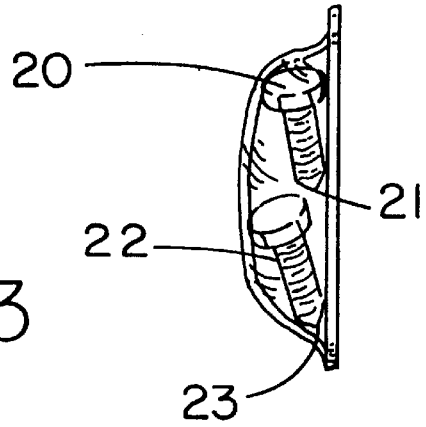
FIG. 3 is a perspective view of the punch members of the present invention.

With reference now to the drawings, and in particular to FIGS. 1 through 3 thereof, a new bolt hole marker embodying the principles and concepts of the present invention and generally designated by the reference numeral 10 will be described.

As best illustrated in FIGS. 1 through 3, the bolt hole marker 10 generally comprises an elongate angled base member 11 having a first elongate portion 12, and a second elongate portion 16 integrally attached to and angled relative to said first elongate portion 12. The first elongate portion 12 has a slot 14 in an end 13 thereof. The end 13 of the first elongate portion 12 is essentially U-shaped. The slot 14 is adapted to receive an anchor bolt 27. The second elongate portion 16 also has a slot 18 in an end 17 thereof. The end of the second elongate portion 16 is essentially U-shaped. The slot 18 of the second elongate portion 16 is adapted to receive an anchor bolt 27. The second elongate portion 16 is angled relative to the first elongate portion 12 with the second elongate portion 16 being angled at approximately 30 degrees relative to the first elongate portion 12 and with the top side 15 of the first elongate portion 12 being angled at approximately 150 degrees from the top side 19 of the second elongate portion 16.

A first punch member 20 is securely attached to and disposed through the first elongate portion 12. The first punch member 20 has a tip 21 at a bottom thereof with the tip 21 being disposed approximately 3¼ inches from the slot 14 and from an anchor bolt 27 received in the slot 14. The first elongate portion 12 is essentially a thin planar piece having a top side 15 and a bottom side. The first punch member 20 is securely disposed from the top side 15 through the bottom side.

A second punch member 22 is securely attached to and disposed through the second elongate portion 16. The second punch member 22 has a tip 23 at a bottom thereof with the tip 23 being disposed approximately 5¼ inches from the slot 18 of the second elongate portion 16 and from an anchor bolt 27 received in the slot 18 thereof. The second elongate portion 16 is essentially a thin planar piece having a top side 19 and a bottom side. The second punch member 22 is securely disposed from the top side 19 through the bottom side. The first 20 and second 22 punch members are essentially screws each essentially having a pointed tip 21,23 which is adapted to make an indentation in a sill member 25 for positioning an anchor bolt 27 in a foundation 26.

In use, the user first positions a sill member 25 upon a foundation 26 where holes for anchor bolts are to be drilled. The user then places the bottom side of the selected elongate portion 12,16 upon the sill member 25 with an anchor bolt 27 being received in the slot 14,18 of the selected elongate portion 12,16. Using a hammer 28, the user pounds a top of the punch member 20,22 which should be disposed upon the sill member 25 so that an indentation is made in the sill member 25 identifying the location where a hole for the anchor bolt 27 should be drilled.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bolt hole marker comprising:

an elongate angled base member having a first elongate portion and a second elongate portion integrally attached to and angled relative to said first elongate portion, wherein said second elongate portion is angled at approximately 30 degrees relative to said first elongate portion, wherein either of said portions is positionable in a generally horizontal orientation such that an opposing portion of said base member angles upwardly away in a manner so as to permit grasping onto said opposing portion by a hand of the user, wherein said first elongate portion includes a slot in an end thereof, said slot being adapted to receive an anchor bolt, wherein said first elongate portion comprises a thin planar piece having a top side and a bottom side, a first punch member being threadably disposed from said top side through said bottom side of said first elongate portion, wherein said second elongate portion includes a slot in an end thereof, said slot being adapted to receive an anchor bolt, wherein said second elongate portion is essentially a thin planar piece having a top side and a bottom side, a second punch member being threadably disposed from said top side through said bottom side of said second elongate portion;

said first punch member being threadably coupled to and disposed through said first elongate portion such that said first punch member is replaceable, wherein said first punch member has a tip at a bottom thereof, said tip being disposed approximately 3¼ inches from said slot in said end of said first elongate portion and from the anchor bolt received in said slot;

said second punch member being threadably coupled to and disposed through said second elongate portion such that said second punch member is replaceable, wherein said second punch member has a tip at a bottom thereof, said tip being disposed approximately 5¼ inches from said slot of said end of said second elongate portion and from the anchor bolt received in said slot; and wherein each of said punch members comprises a screw having a pointed tip for making an indentation in a sill member for the purpose of positioning a drill bit so as to allow a user to drill holes along the sill member to facilitate proper positioning of the sill member over corresponding anchor bolts so the sill member can be secured to the foundation.

* * * * *